United States Patent [19]

Armstrong et al.

[11] Patent Number: 4,798,425

[45] Date of Patent: Jan. 17, 1989

[54] COMPARTMENT ASSEMBLY FOR A REFRIGERATOR

[75] Inventors: William J. Armstrong; Richard A. Stich, both of Louisville, Ky.

[73] Assignee: General Electric Company, Louisville, Ky.

[21] Appl. No.: 158,717

[22] Filed: Feb. 22, 1988

[51] Int. Cl.[4] ..... A47B 88/00

[52] U.S. Cl. ..... 312/328; 312/138 A

[58] Field of Search ..... 312/626, 327, 328, 138 A, 312/308, 29

[56] References Cited

U.S. PATENT DOCUMENTS

| | | | |
|---|---|---|---|
| 1,258,520 | 3/1918 | Backermann . | |
| 2,089,209 | 8/1937 | Rabkin | 312/328 X |
| 2,525,446 | 10/1950 | Carbary | 312/236 |
| 2,658,727 | 11/1953 | Eck | 257/3 |
| 3,375,936 | 4/1968 | Kessler | 211/176 |
| 3,469,711 | 9/1969 | Swaneck et al. | 211/176 |
| 3,647,075 | 3/1972 | Aue | 211/153 |
| 3,807,822 | 4/1974 | Amore | 312/138 A |
| 4,186,978 | 2/1980 | Thomson | 312/138 A |
| 4,740,042 | 4/1988 | Stich et al. | 312/138 A |

FOREIGN PATENT DOCUMENTS

| | | | |
|---|---|---|---|
| 222147 | 7/1960 | Austria | 312/138 A |

*Primary Examiner*—Joseph Falk

*Attorney, Agent, or Firm*—Frederick P. Weidner; Radford M. Reams

[57] ABSTRACT

A compartment assembly for a refrigerator comprising a panel on the inside of a refrigerator door, the panel having a recess area with a rear wall, a top wall and at least two spaced apart vertical dikes directed outwardly from the rear wall. The recess area has at the bottom an inwardly directed lip and the dikes have a side wall and a front face with the front face having a slot. There is a tray having a bottom wall, an integrally formed rear wall, front wall, and side walls, with the side walls each having a flange projecting outwardly perpendicular to the side walls and each of the flanges have a rearwardly projecting hook shaped element parallel to the side walls. The tray has a length such that the hook shaped elements cooperate with the slots in the vertical dikes for engagement and a horizontal depth such that the front wall projects outwardly from the dikes and the rear wall extends to the rear wall of the recess and rests on the projecting lip. A cover having a body portion and end portions is pivotally secured at the end portions to the side walls of the tray.

8 Claims, 2 Drawing Sheets

FIG. 1
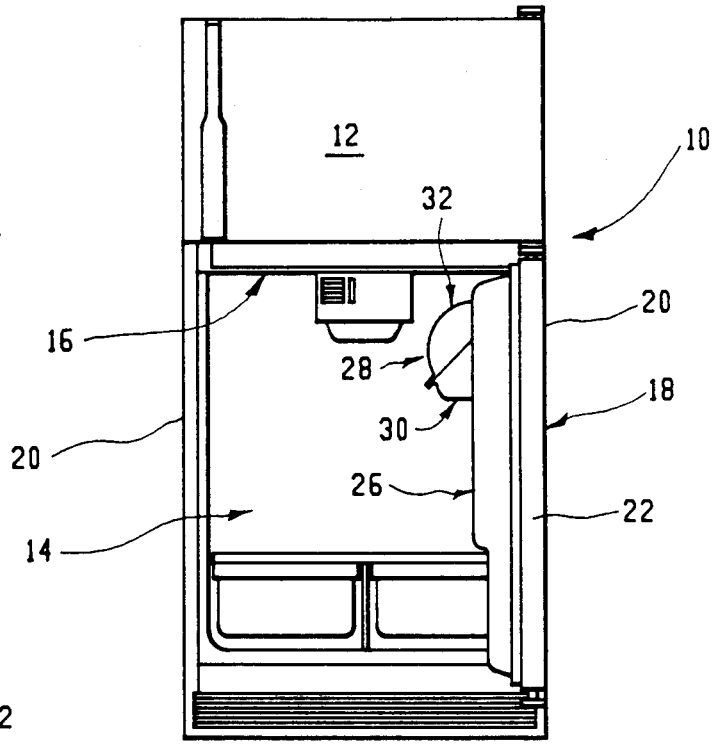
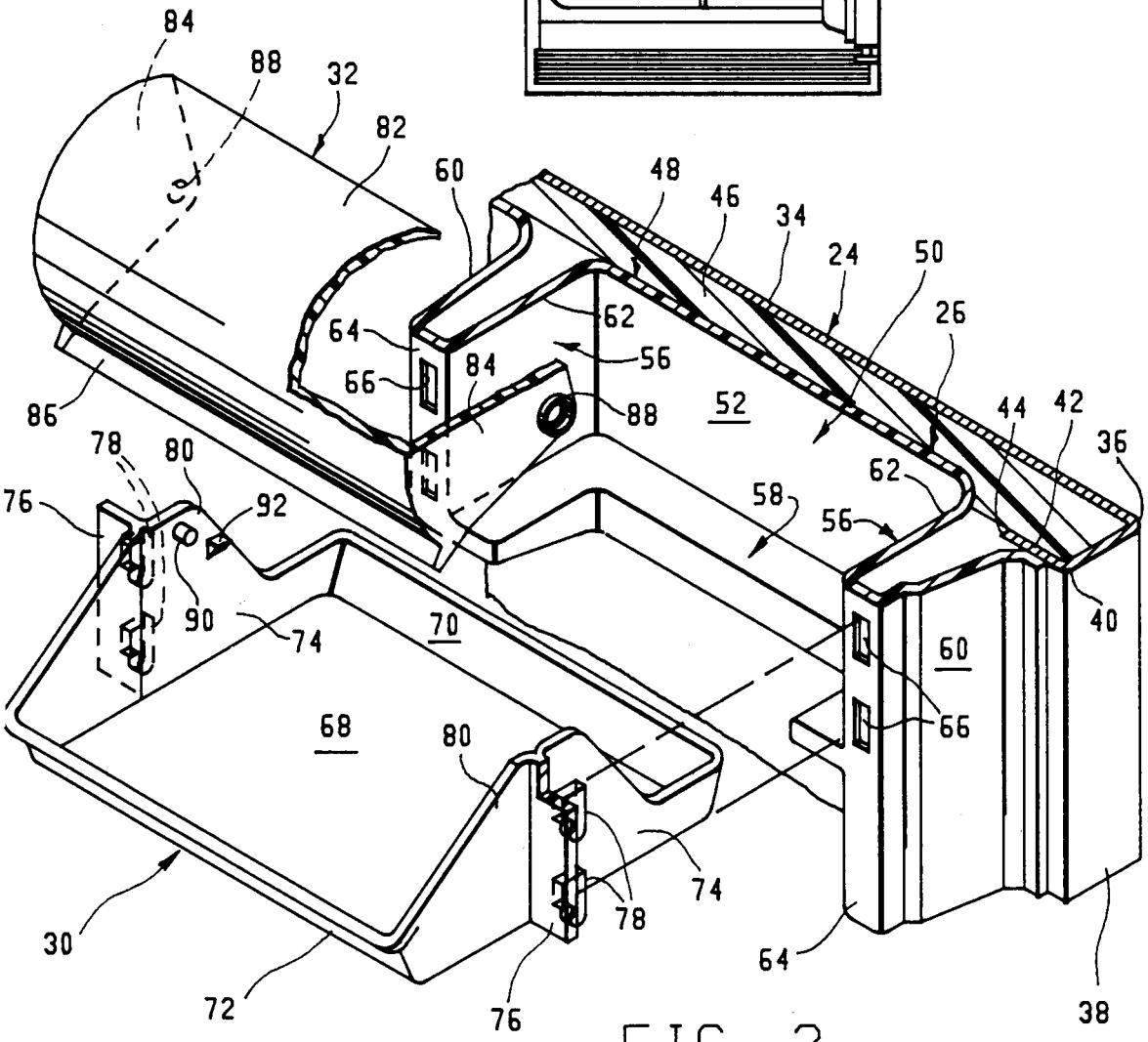
FIG. 2

COMPARTMENT ASSEMBLY FOR A REFRIGERATOR

BACKGROUND OF THE INVENTION

In household refrigerators it is common to have a dairy compartment for the storage of food items such as butter and cheeses. The dairy compartment is usually positioned on the inside of the fresh food compartment door and in most cases is molded into the vacuum formed inner door plastic panel. Because the inner door plastic panel is vacuum formed the depth of the dairy compartment is limited to the draw ratios associated with vacuum forming processes. That is, because the inner door plastic panel is vacuum formed the depth of the dairy compartment is quite restricted relative to the thickness of the plastic sheet being formed. It is also common to have a cover over the dairy compartment which may be closed to prevent air flow across the stored food items and opened to gain access to the items stored in the compartment. Heretofore, the ends of the rotatable cover have been pivotally mounted on support pins molded into the ends of the doors that project through holes in the inner door plastic panel. It has been found, however, that due to the repeated rotation of the dairy compartment door that the thin inner door plastic panel tends to wear in that area which detrimentally affects the inner door panel and the operation of the rotatable dairy compartment cover.

It is desirable to have the dairy compartment of a refrigerator much deeper in depth than the limits dictated by vacuum forming process to thereby afford greater storage space within the container. It is also desirable to have the cover of the dairy compartment not pivot on the surface of the inner door plastic panel, which is quite thin and can result in deformation. By this invention both of these desirable attributes may be accomplished.

SUMMARY OF THE INVENTION

A compartment assembly for a refrigerator comprising a panel on the inside of a refrigerator door, said panel having a recess area with a rear wall, a top wall and at least two spaced apart vertical dikes directed outwardly from the rear wall. The recess area has at the bottom thereof an inwardly projecting lip, the dikes having a side wall and a front face and the front face has a slot. The assembly also includes a tray having a bottom wall, an integrally formed rear wall, front wall and side walls, said side walls each having a flange projecting outwardly perpendicular to the side walls and the flanges each have a rearwardly projecting hook shaped element parallel to the side walls. The tray has a length such that the hook shaped elements cooperate with the slots in the vertical dikes for engagement and a horizontal depth such that the front wall projects outwardly from the dikes and the rear wall extends to the rear wall of the recess and rests on the projecting lip. There is also provided a cover having a body portion and end portions which is pivotally secured at the end portions to the side walls of the tray.

BRIEF DESCRIPTION OF THE DRAWINGS

FIG. 1 is a front elevational view of a household refrigerator incorporating the compartment assembly of the present invention.

FIG. 2 a perspective exploded view of the compartment assembly of the invention incorporated in the refrigerator of FIG. 1.

DESCRIPTION OF THE PREFERRED EMBODIMENT

Figure 3:
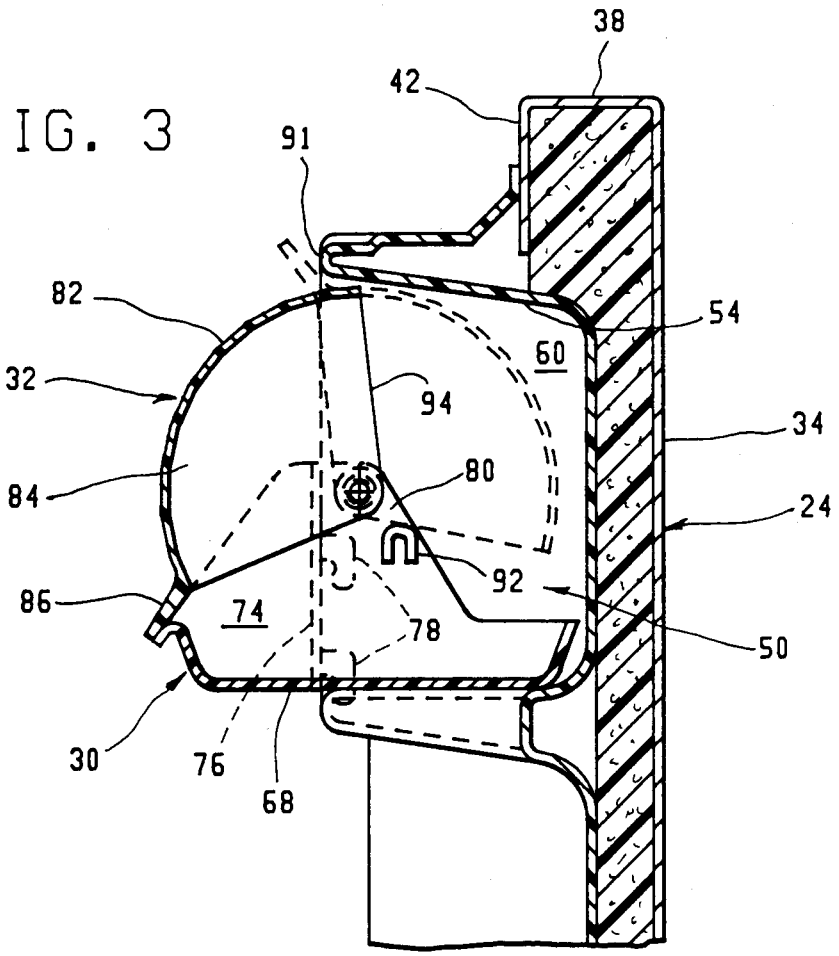
FIG. 3 is a cross-sectional side elevational view of the compartment assembly of the present invention incorporated in the refrigerator FIG. 1.

With reference to FIG. 1, there is shown a refrigerator cabinet 10 having a below-freezing temperature freezer compartment at the top of the refrigerator which is shown having a closed access door 12 at the top of the refrigerator and an above-freezing temperature fresh food compartment 14 at the bottom of the refrigerator with the freezer and fresh food compartments being separated by a mullion partition 16. The refrigerator cabinet comprises an outer metal casing 18 having side walls 20 and an inner liner 22 usually formed by vacuum forming plastic material. The fresh food compartment 14 has an access door 22 which in FIG. 1 is shown in its open position and hinged to the right hand side of the refrigerator cabinet 10. The access door 22 has an outer metal shell 24 and an inner door plastic panel 26. Mounted on the inner door plastic panel 26 is a compartment assembly 28 having a tray 30 and a cover 32.

Figure 4:
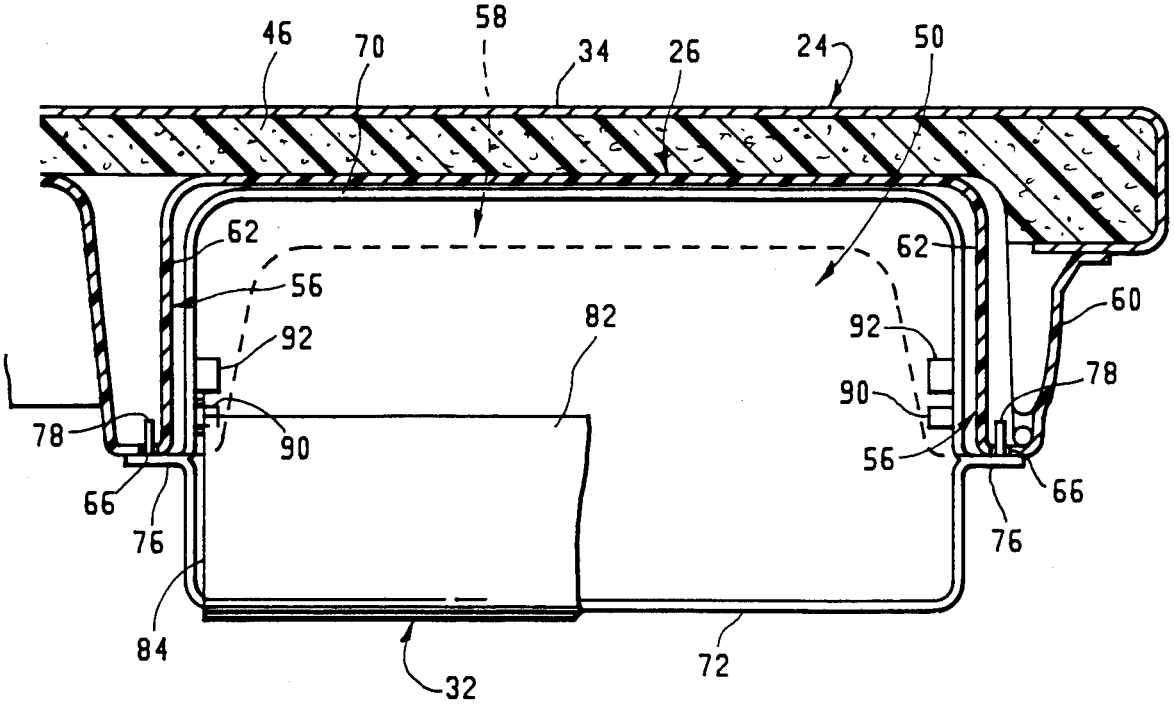
FIG. 4 is a cross-sectional top plan view of the compartment assembly of the present invention incorporated in the refrigerator of FIG. 1.

With reference particularly to FIGS. 2–4, the compartment assembly 28 will be described in detail. The outer metal shell 24 is formed into an appropriate configuration which has a front wall 34 and a U-shaped bend at both ends formed by a right angle bend 36, a straight section 38 with a second right angle bend 40 and an inwardly turned leg 42 parallel to the front wall 34 with a terminal end 44. After the outer metal shell 24 is formed it may be placed in a mold and thermal insulation 46 is placed on the inside of the outer metal shell. Subsequent to the placement of the thermal insulation 46 in the outer metal shell 24, an inner door plastic panel 48 is secured to the outer metal shell 24 usually around the periphery of the outer metal shell 24. In such a construction the inner door panel 48 is separated from the outer metal shell 24 by the thermal insulation 46 and is secured to the outer metal shell by means (not shown) such as a metal retainer strip and screw fasteners around the periphery of the access door. The retainer strip may also carry the sealing gasket (not shown) of the door.

In the compartment assembly of the present invention the inner door plastic panel 26 has a recess area 50 with a rear wall 52, a top wall 54 (FIG. 3) and at least two spaced apart vertical dikes 56 which are directed outwardly from the rear wall 52. The dikes 56 each have two side walls 60 and 62 spaced from each other and joined with a front face 64, which front face of each of the dikes has vertically aligned spaced apart rectangular shaped slots 66. The recess area 50 has at the bottom thereof an inwardly projecting lip 58 which in the preferred embodiment extends along the rear wall 52 and the inside of the side walls 60 and 62 of the vertical dikes 56.

The compartment assembly 28 also includes a tray 30 having a bottom wall 68 and integrally formed rear wall 70, front wall 72, and side walls 74. Each of the side walls 74 have a flange 76 projecting outwardly perpendicular to the side walls and each of the these flanges have a rearwardly projecting hook shaped element 78 and in the case of the preferred embodiment there are two hook shaped elements vertically aligned in spaced relationship on each flange. The tray 30 has a length such that the hook shaped elements 78 on the flanges cooperate with the slots 66 in the vertical dikes 60 for engagement. The tray has a horizontal depth such that the front wall 72 projects outwardly from the dikes 60 a substantial distance and the rear wall 70 extends nearly to the rear wall of the recess 50 so that the tray rests on the projecting lip 58. It will be noted that the side walls 74 of the tray have their center portion 80 substantially higher vertically than the portions of the side wall joining the rear wall 70 and the front wall 72. The tray 30 may be molded from suitable plastic material such as high impact polystyrene.

The compartment assembly 28 further includes a cover 32 having a body portion 82 which in the case of the preferred embodiment is shown as a semi-cylindrical shape. The cover 32 also includes end portions 84 which are integrally formed with the body portion 82. The cover has a front terminal lip 86 which in the preferred embodiment extends the length of the body portion 82. Each of the end portions 84 have a bearing member 88. The cover may be molded from suitable plastic material.

To pivotally mount the cover 32 on the tray 30 there is provided inwardly directed pivot pins 90 located on the inside of the side walls 74 near the top of the center portion 80 of the tray. These pivot pins are slightly smaller in diameter than the bearing members 88 of the end portions of the cover so that the pivot pins 90 may be received in the bearing members 88. By inwardly deflecting the ends of the side walls to reduce the distance between the side walls of the cover in the bearing area so that the distance between the bearings is shorter than the distance between the pivot pins 90 the cover may be received between the side walls of the tray. When the bearing members 88 of the cover are in their proper alignment relative to the pivot pins release of the deflected side walls will allow the side walls to spring back and thereby support the cover with the bearings positioned on the pins.

With particular reference to FIG. 3, the completed compartment assembly 28 is shown in cross-section where in full line the cover 32 is shown in its closed position and in dotted line in its open position. It is desirable that when the user rotates the cover 32 to open and gain access to items stored in the compartment that the rotational movement be limited to prevent the lip 86 from abutting the front face 91 of top wall 54 as with repeated usage of the rotatable cover the thin plastic material comprising the front face 91 of top wall 54 could be detrimentally affected. To prevent this, there is provided an inwardly projecting stop element 92 on each of the side walls 74 of the tray 30. These stop elements 92 are positioned such that upon rotation of the cover 32 in the clockwise direction as viewed in FIG. 3 the forward rotating edge 94 of the side wall 84 engages the stop element 92 as shown in dotted line in FIG. 3 before the lip 96 engages the front face 91 of top wall 54 of the recess area 50.

With particular reference to FIG. 3, it will be noted that the vertical height of the assembled tray and cover relative to the vertical height of the recess area between the projecting lip 58 and the top wall 54 prevents vertical movement of the assembled tray and cover sufficiently to prevent removal of the hook shaped elements 78 from engagement with the vertically aligned slots 66 in the dikes 60. The reason for this is that with such an arrangement the assembled tray and cover cannot be accidentally removed by unintentional force against the bottom of the tray that could otherwise cause dislodgement of the hooks from the slots and allow the tray and cover to fall from its location in the recess 50. In order to remove the tray 30 intentionally such as for cleaning, the cover is simply removed from the tray by deflecting inwardly the side walls 84 to disengage the bearings 88 from the pivot pins 90 and move the cover outwardly from the tray and recess 50. The tray may then be easily removed by raising the tray to disengage the hook shaped elements from the slot 66 and remove it from the recess 50.

While, in accordance with the Patent Statutes, there has been described what at present is considered to be the preferred embodiment of the invention, it will be obvious to those skilled in the art that various changes and modifications may be made thereto without departing from the invention. It is, therefore, intended by the appended claims to cover all such changes and modifications as fall within the true spirit and scope of the invention.

What is claimed is:

1. A compartment assembly for a refrigerator comprising:

a panel on the inside of a refrigerator door, said panel having a recess area with a rear wall, a top wall and at least two spaced apart vertical dikes directed outwardly from the rear wall, said recess area having at the bottom thereof an inwardly projecting lip, said dikes having a side wall and a front face, said each front face having a slot, a tray having a bottom walls and integrally formed rear wall, front wall, and side wall, said side walls each having a flange projecting outwardly perpendicular to the side walls, said flanges each having a rearwardly projecting hook shaped element parallel to the side walls, said tray having a length such that the hook shaped elements cooperate with the slots in the vertical dikes for engagement and a horizontal depth such that the front wall projects outwardly from the dikes and the rear wall extends to the rear wall of the recess and rests on the projecting lip, and a removable cover having a body portion and end portions pivotly secured at the end portions to the side walls of the tray, said assembled tray and cover having a vertical height relative to the vertical height of the recess area between the projections lip and top wall less than the vertical distance necessity to withdraw the book shaped elements from engagement with the slots in the vertical dikes, whereby the hook shaped elements on the tray cannot be disengaged from the slots in the dike without first removing the cover from the tray.

2. The compartment assembly for a refrigerator of claim 1 wherein there are two vertically aligned spaced apart slots in the front face of each dike and there are two vertically spaced hook shaped elements on each of the flanges of said side wall.

3. The compartment assembly for a refrigerator of claim 1 wherein the cover has a lip along the front edge thereof that engages the front wall of the tray when in the closed position.

4. The compartment assembly for a refrigerator of claim 1 wherein the cover is semi-cylindrical in shape.

5. The compartment assembly for a refrigerator of claim 1 wherein the side walls of the tray have inwardly projecting pivot elements to rotatably engage the cover.

6. The compartment assembly for a refrigerator of claim 1 wherein the side walls of the tray have inwardly projecting stop elements to limit the rotation of the cover.

7. The compartment assembly for a refrigerator of claim 1 wherein the panel, tray, and cover are all molded from plastic material.

8. The compartment assembly for a refrigerator of claim 1 wherein the side walls of the tray have their center portion substantially higher vertically than the portions joining the rear wall and front wall.

* * * * *

UNITED STATES PATENT AND TRADEMARK OFFICE

CERTIFICATE OF CORRECTION

PATENT NO. : 4,798,425

DATED : January 17, 1989

INVENTOR(S) : William J. Armstrong and Richard A. Stich

It is certified that error appears in the above-identified patent and that said Letters Patent is hereby corrected as shown below:

Claim 1, line 35, delete "walls" and substitute --wall--.

Claim 1, lines 51-52, delete "projections" and insert --projecting--.

Claim 1, line 52, after "and" insert --the--.

Claim 1, line 53, delete "necessity" and substitute --necessary--;
delete "book" and substitute --hook--.

Claim 2, line 62, delete "said" and substitute --each--.

Signed and Sealed this

Twenty-fifth Day of July, 1989

*Attest:*

DONALD J. QUIGG

*Attesting Officer*

*Commissioner of Patents and Trademarks*